United States Patent [19]

Lathers

[11] Patent Number: 4,926,783

[45] Date of Patent: May 22, 1990

[54] RECREATIONAL BOAT SEAT/SUN DECK

[75] Inventor: Michael W. Lathers, Metamora, Mich.

[73] Assignee: Outboard Marine Corporation, Wauekgan, Ill.

[21] Appl. No.: 216,728

[22] Filed: Jul. 8, 1988

[51] Int. Cl.[5] ..... B63B 29/04

[52] U.S. Cl. ..... 114/363; 114/343; 297/14; 5/3; 5/118

[58] Field of Search ..... 114/188, 189, 363, 343; 297/14, 331, 334, 335, 338, 297; 5/3–7, 29, 49, 50, 118

[56] References Cited

U.S. PATENT DOCUMENTS

| | | | |
|---|---|---|---|
| 126,984 | 5/1872 | Rice . | |
| 136,734 | 3/1873 | Johnson . | |
| 1,428,018 | 9/1922 | Erickson . | |
| 1,473,945 | 11/1923 | Whiting . | |
| 1,509,863 | 9/1924 | Erickson . | |
| 1,752,226 | 3/1930 | Bragg . | |
| 1,769,343 | 7/1930 | Henry . | |
| 2,257,425 | 9/1971 | Mezzetti | 5/3 |
| 3,376,587 | 4/1968 | Staron | 114/363 |
| 3,427,667 | 2/1969 | Ratcliff | 5/3 |
| 4,005,898 | 2/1977 | Way | 5/118 |
| 4,264,103 | 4/1981 | Peresada et al. | 297/432 |
| 4,364,602 | 12/1982 | Rigazio | 297/334 |
| 4,639,037 | 1/1987 | Maruyama et al. | 297/334 |

FOREIGN PATENT DOCUMENTS

| | | | |
|---|---|---|---|
| 418325 | 9/1925 | Fed. Rep. of Germany . | |
| 1065584 | 9/1959 | Fed. Rep. of Germany | 5/17 |
| 500904 | 5/1872 | France . | |
| 76810 | 7/1947 | Norway . | |

*Primary Examiner*—Sherman D. Basinger
*Assistant Examiner*—Thomas J. Brahan
*Attorney, Agent, or Firm*—Michael, Best & Friedrich

[57] ABSTRACT

A marine vehicle comprising a first generally vertical wall, a second generally vertical wall extending generally perpendicular to the first wall, a first seat bottom member, a second seat bottom member, a hinge mechanism supporting the first seat bottom member for movement between a first position wherein the first seat bottom member extends generally horizontally from the first wall and a second position wherein the first seat bottom member extends generally vertically against the first wall, and a hinge mechanism supporting the second seat bottom member for movement between an operating position wherein the second seat bottom member extends generally horizontally from the second wall and is generally coplanar with the first seat bottom member when the first seat bottom member is in the first position, and a storage position wherein the second seat bottom member extends generally vertically against the second wall.

27 Claims, 2 Drawing Sheets

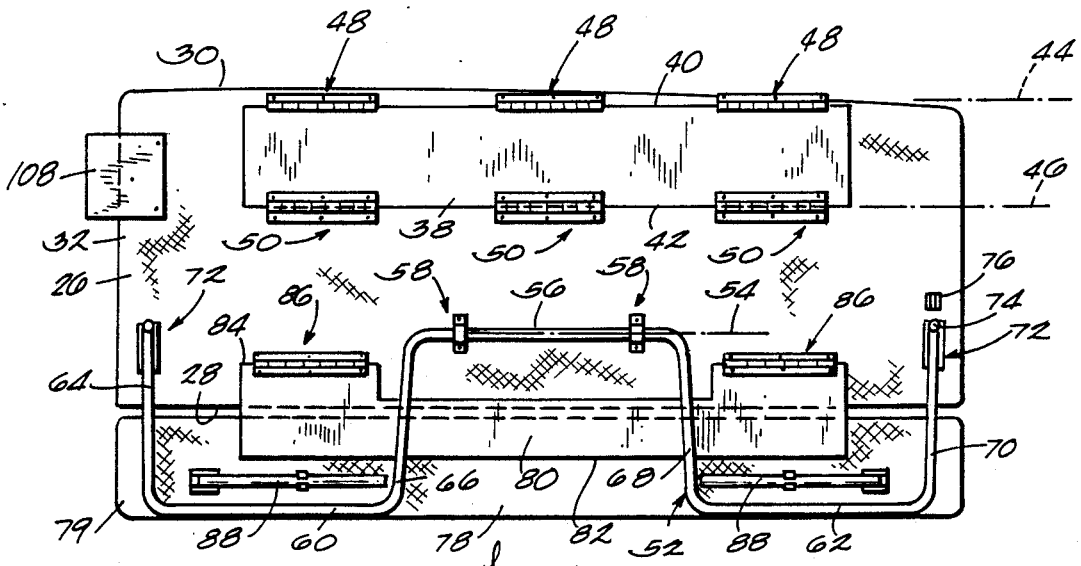
Fig. 6
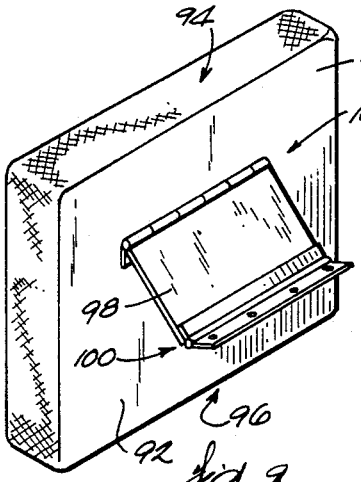
Fig. 9
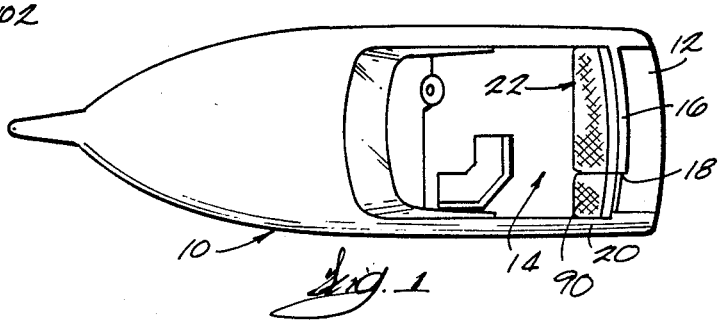
Fig. 1
Fig. 7
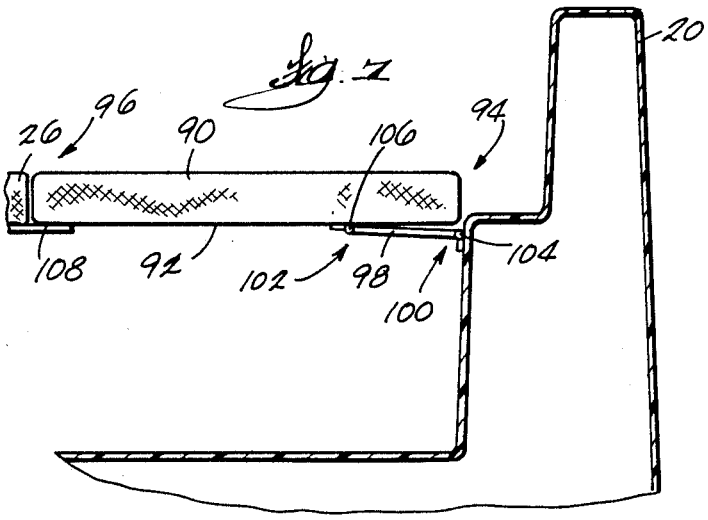
Fig. 8
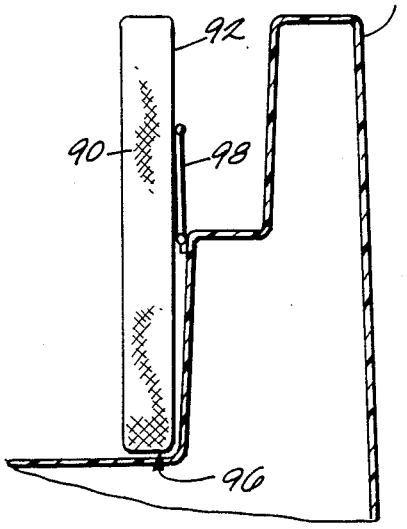

RECREATIONAL BOAT SEAT/SUN DECK

BACKGROUND OF THE INVENTION

The invention relates to recreational boats, and, more particularly, to seats and sun decks for such boats.

It is known to provide a recreational boat with a seat that can be pivoted upwardly against a generally vertical wall such as a transom wall. Such a seat typically includes a seat bottom cushion having a rearward end pivotally connected to the wall by a conventional hinge apparatus. A disadvantage of this construction is that the seat bottom cushion may extend upwardly to an undesirable height (e.g., above the top of the wall) when it is pivoted upwardly against the wall.

It is also known to provide a seat back cushion mounted on the wall above the seat bottom cushion. The seat back cushion may prevent the seat bottom cushion from being pivoted to a truly vertical position.

SUMMARY OF THE INVENTION

The invention provides a marine vehicle comprising a generally vertical wall, a seat bottom member, and means supporting the seat bottom member for movement between a first position wherein the seat bottom member extends generally horizontally from the wall and a second position wherein the seat bottom member extends generally vertically against and the wall, the supporting means including a mounting member having first and second ends, means connecting the first end of the mounting member to the wall for pivotal movement about a first generally horizontal axis, and means connecting the second end of the mounting member to the seat bottom member for pivotal movement about a second axis generally parallel to the first axis.

In one embodiment, the marine vehicle further comprises a seat back member mounted on the wall, and the seat back member is located between the set bottom member and the wall when the seat bottom member is in the second position.

In one embodiment, the seat back member has a thickness, the supporting means further includes a mounting block fixedly secured to and extending outwardly from the wall, the mounting block having a thickness approximately equal to the thickness of the seat back member, and the first end of the mounting member is pivotally connected to the mounting block.

In one embodiment, the seat bottom member has a forward end, and the marine vehicle further comprises an extension member, and means supporting the extension member for movement between an extended position wherein the extension member is substantially coplanar with the seat bottom member and extends outwardly from the forward end of the seat bottom member, and a retracted position wherein the extension member is located beneath the forward end of the seat bottom member.

In one embodiment, the marine vehicle further comprises a second generally vertical wall extending generally perpendicular to the first-mentioned wall, a second seat bottom member, and means supporting the second seat bottom member for movement between an operating position wherein the second seat bottom member extends generally horizontally from the second wall and is generally coplanar with the first seat bottom member when the first seat bottom member is in the first position, and a storage position wherein the second seat bottom member extends generally vertically against the second wall.

The invention also provides a marine vehicle comprising a first generally vertical wall, a second generally vertical wall extending generally perpendicular to the first wall, a first seat bottom member, a second seat bottom member, means supporting the first seat bottom member for movement between a first position wherein the first seat bottom member extends generally horizontally from the first wall and a second position wherein the first seat bottom member extends generally vertically against the first wall, and means supporting the second seat bottom member for movement between an operating position wherein the second seat bottom member extends generally horizontally from the second wall and is generally coplanar with the first seat bottom member when the first seat bottom member is in the first position, and a storage position wherein the second seat bottom member extends generally vertically against the second wall.

The invention also provides a marine vehicle comprising a generally vertical wall, a seat bottom member having a forward end, means supporting the seat bottom member for movement between a first position wherein the seat bottom member extends generally horizontally from the wall, and a second position wherein the seat bottom member extends generally vertically against the wall, an extension member, and means supporting the extension member for movement between an extended position wherein the extension member is substantially coplanar with the seat bottom member and extends outwardly from the forward end of the seat bottom member, and a retracted position wherein the extension member is located beneath the forward end of the seat bottom member.

A principal feature of the invention is the provision of supporting means including a mounting member having first and second ends, means connecting the first end of the mounting member to a wall for pivotal movement about a generally horizontal axis, and means connecting the second end of the mounting member to a seat bottom cushion for pivotal movement about a second axis generally parallel to the first axis. This arrangement permits the seat bottom cushion to be folded up against the wall without having the cushion extend upwardly to an undesirable height.

Another principal feature of the invention is the provision of a mounting block extending outwardly from the wall, the mounting block having a thickness approximately equal to the thickness of a seat back cushion mounted on the wall, and the first end of the mounting member being pivotally connected to the mounting block. This arrangement permits the seat bottom cushion to be pivoted to a truly vertical position while having the seat back cushion between the seat bottom cushion and the wall.

Another principal feature of the invention is the provision of a second seat bottom cushion and means supporting the second seat bottom cushion for movement between a storage position wherein the second seat bottom cushion extends generally vertically against a second wall, and an operating position wherein the second seat bottom cushion extends generally horizontally from the second wall and wherein the second seat bottom cushion is generally coplanar with the first seat bottom cushion when the first seat bottom cushion is in the first position.

Another principal feature of the invention is the provision of a seat bottom member supported for movement between a first position wherein the seat bottom member extends generally horizontally from a wall, and a second position wherein the seat bottom member extends generally vertically against the wall, an extension member, and means supporting the extension member for movement between an extended position wherein the extension member is substantially coplanar with the seat bottom member and extends outwardlY from the forward end of the seat bottom member, and a retracted position wherein the extension member is located beneath the forward end of the seat bottom member. This construction provides a seat that can be folded up against a wall and can also be extended to serve as a sun deck.

Other features and advantages of the invention will become apparent to those skilled in the art upon review of the following detailed description, claims and drawings.

DESCRIPTION OF THE DRAWINGS

FIG. 1 is a top plan view of a recreational boat including a seat apparatus embodying the invention.

FIG. 6 is a view taken along line 6—6 in FIG. 5.

FIG. 7 is a view taken along line 7—7 in FIG. 2.

FIG. 8 is a view similar to FIG. 7 and showing the second seat bottom cushion folded up.

FIG. 9 is a perspective view of the underside of the second seat bottom cushion.

Figure 2:
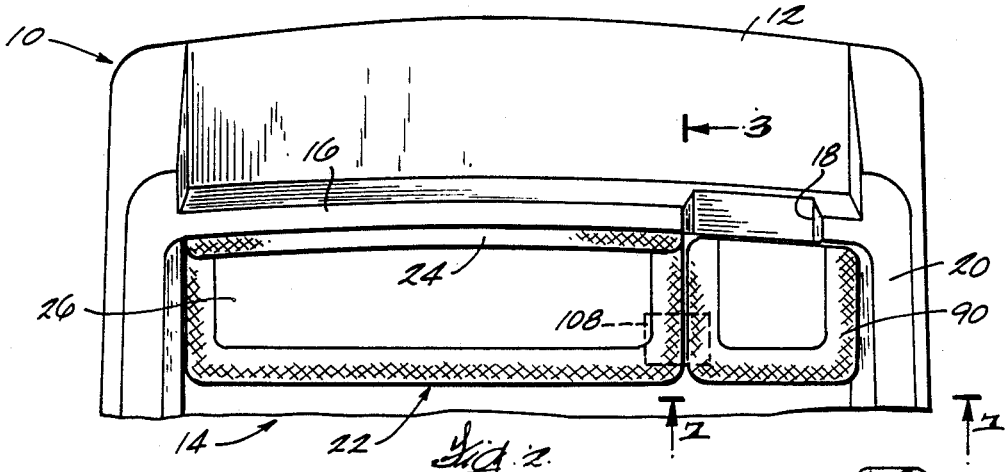
FIG. 2 is an enlarged, partial plan view of the seat apparatus.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

A recreational boat or marine vehicle 10 embodying the invention is illustrated in the drawings. As shown in FIGS. 1 and 2, the boat 10 comprises a transom platform 12, a seating area 14, and a generally vertical transom wall 16 separating the seating area 14 from the transom platform 12. The transom wall 16 has therein an opening 18 affording access from the seating area 14 to the transom platform 12. The boat 10 also comprises a generally vertical second or side wall 20 extending generally perpendicular to the transom wall 16 and further defining the seating area 14.

The boat 10 also comprises a seat apparatus 22. The seat apparatus 22 comprises a seat back member or cushion 24 mounted on the transom wall 16, and a first seat bottom member or cushion 26 having (see FIG. 3) forward and rearward ends 28 and 30, respectively, and an underside 32. The seat apparatus 22 also comprises means 34 supporting the seat bottom cushion 26 for movement between a first or horizontal position wherein the seat bottom cushion 26 extends generally horizontally from the transom wall 16 and is below the seat back cushion 24 and a second or vertical position wherein the seat bottom cushion 26 extends generally vertically against the transom wall 16 with the seat back cushion 24 between the seat bottom cushion 26 and the transom wall 16. While various suitable supporting means 34 can be employed, in the preferred embodiment, the means 34 supporting the seat bottom cushion 26 includes a mounting block 36 fixedly secured to and extending outwardly from the transom wall 16, the mounting block 36 having a thickness approximately equal to the thickness of the seat back cushion 24. The supporting means 34 also includes (see FIGS. 3 and 6) a mounting member or plate 38 having first and second ends, 40 and 42, respectively, means connecting the first end 40 of the mounting member 38 to the mounting block 36 (and thus to the transom wall 16) for pivotal movement about a first generally horizontal axis 44, and means connecting the second end 42 of the mounting member 38 to the underside 32 of the seat bottom cushion 26 for pivotal movement about a second axis 46 generally parallel to the first axis 44. Preferably, the first end 40 of the mounting member 38 is pivotally connected to the mounting block 36 by conventional hinge apparatus 48 and the second end 42 of the mounting member 38 is pivotally connected to the seat bottom cushion 26 by conventional hinge apparatus 50.

Figure 3:
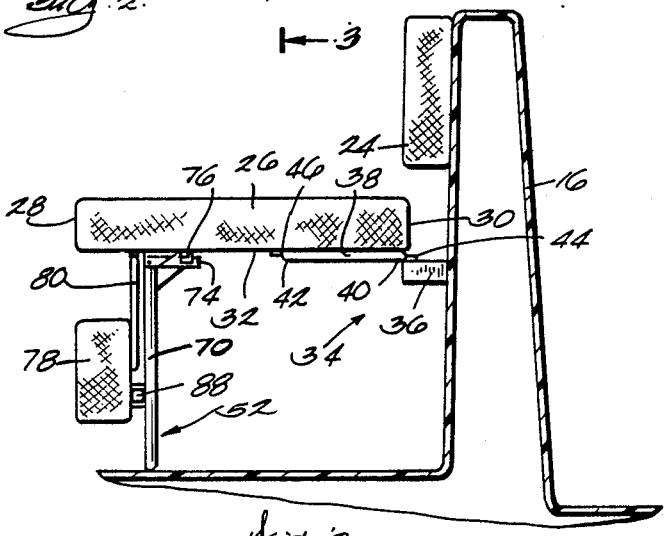
FIG. 3 is a view taken along line 3—3 in FIG. 2.
Figure 5:
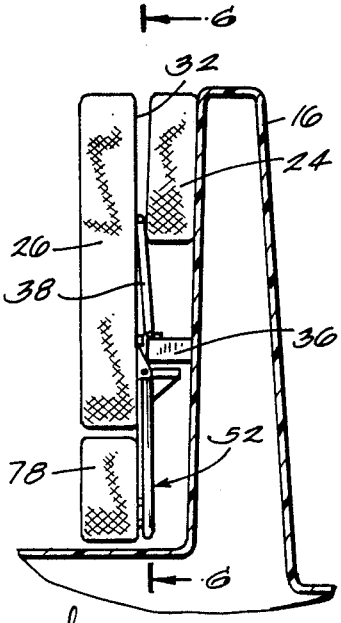
FIG. 5 is a view similar to FIG. 3 and showing the seat apparatus folded up.

As shown in FIG. 3, the mounting plate 38 extends horizontally and the rearward end 30 of the seat bottom cushion 26 actually rests on top of the mounting plate 38 when the seat bottom cushion 26 is in the first or horizontal position. Referring to FIG. 3, the seat bottom cushion 26 is moved from the horizontal position to the vertical position by rotating the seat bottom cushion 26 counterclockwise relative to the mounting plate 38 and by rotating the mounting plate 38 clockwise relative to the mounting block 36. As shown in FIG. 5, the mounting plate 38 extends generally vertically and the underside 32 of the seat bottom cushion 26 faces the underside of the mounting plate when the seat bottom cushion 26 is in the second or vertical position. Because the thickness of the mounting block 36 is approximately equal to the thickness of the seat back cushion 24, the seat bottom cushion 26 is evenly spaced from the transom wall 16 by the mounting block 36 and by the seat back cushion 24.

Figure 10:
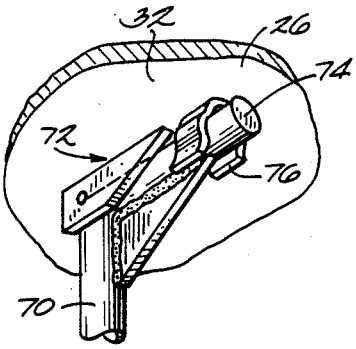
FIG. 10 is a partial perspective view of the underside of the first seat bottom cushion.

The apparatus 22 further comprises a retractable leg 52 for supporting the seat bottom cushion 26 in the first or horizontal position. In the illustrated construction, as best shown in FIG. 6, the leg 52 is generally W-shaped and is connected to the underside 32 of the seat bottom cushion 26 for pivotal movement relative thereto about a pivot axis 54 generally parallel to the first and second axes 44 and 46. The leg 52 includes a middle segment 56 extending along the pivot axis 54 and pivotally connected to the seat bottom cushion 26 by a pair of brackets 58. The leg 52 also includes a pair of generally colinear, spaced-apart, first and second deck-engaging segments, 60 and 62, respectively, a first transverse segment 64 connected to the left end (as shown in FIG. 6) of the first deck-engaging segment 60, a second transverse segment 66 connecting the right end of the first deck-engaging segment 60 to the left end of the middle segment 56, a third transverse segment 68 connecting the left end of the second deck-engaging segment 62 to the right end of the middle segment 56, and a forth transverse segment 70 connected to the right end of the second deck-engaging segment 62. The upper ends (as shown in FIG. 6) of the first and fourth transverse segments 64 and 70 are pivotally connected to the underside 32 of the seat bottom cushion 26 by suitable hinge apparatus 72 (FIGS. 6 and 10).

Figure 4:
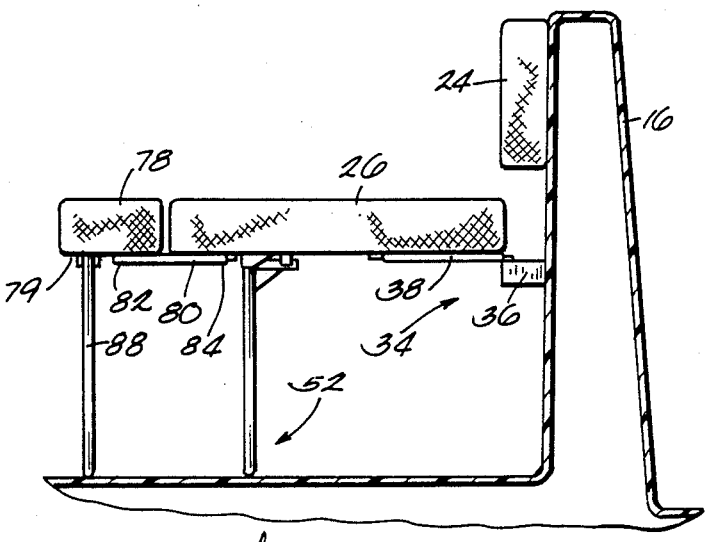
FIG. 4 is a view similar to FIG. 3 and showing the seat apparatus extended.

The leg 52 is movable between a retracted position (shown in FIGS. 5 and 6) and an extended position (shown in FIGS. 3 and 4). Means are provided for securing the leg 52 in the extended position. While various suitable means can be employed, in the preferred embodiment, such means includes (see FIGS. 3, 6 and 10) a perpendicular extension 74 on the upper end of the fourth transverse segment 70, and a clip 76 mounted on the underside 32 of the seat bottom cushion 26 for releasably securing the extension 74 against the underside 32 of the seat bottom member 26.

The apparatus 22 also comprises an extension cushion or member 78 having an underside 79, and means supporting the extension cushion 78 for movement between an extended position (FIGS. 4–6) wherein the extension cushion 78 is substantially coplanar with the seat bottom cushion 26 and extends outwardly from the forward end 28 of the seat bottom cushion 26, and a retracted position (FIG. 3) wherein the extension cushion 78 is located beneath the forward end 28 of the seat bottom cushion 26. While various suitable means can be used for supporting the extension cushion 78, in the preferred embodiment, such means includes a plate 80 having a first end 82 fixed to the underside 79 of the extension cushion 78 and a second end 84 pivotally connected to the underside 32 of the seat bottom cushion 26. As shown in FIG. 6, the plate 80 is preferably connected to the underside 32 of the seat bottom cushion 26 by a pair of hinge apparatus 86. The means supporting the extension cushion 78 also includes a pair of retractable legs 88 for supporting the extension cushion 78 in the extended position. The legs 88 are shown retracted in FIGS. 3, 5 and 6 and are shown extended in FIG. 4.

When the extension cushion 78 is in its extended position and the seat bottom cushion 26 is in its first or horizontal position, as shown in FIG. 4, the seat bottom cushion 26 and the extension cushion 78 form a sun deck. When the apparatus 22 is to be used as a seat, the seat bottom cushion 26 is placed in its horizontal position and the extension cushion 78 is placed in its retracted position, as shown in FIG. 3. When the seat bottom cushion 26 is folded up, i.e., is moved to its second position, the extension cushion 78 is moved to its extended position, as shown in FIG. 5.

The apparatus 22 further comprises (see FIGS. 1, 2 and 7–9) a second seat bottom cushion or member 90 having an underside 92 and inner and outer ends, 94 and 96, respectively, and means supporting the second seat bottom cushion 90 for movement between an operating position (FIGS. 2 and 7) wherein the second seat bottom cushion 90 extends generally horizontally from the side wall 20 and is generally coplanar with the first seat bottom cushion 26 when the first seat bottom cushion 26 is in its first or horizontal position, and a storage position (FIG. 8) wherein the second seat bottom cushion 90 extends generally vertically against the side wall 20.

While various suitable means can be employed for supporting the second seat bottom cushion 90, in the preferred embodiment, such means includes a second mounting member or plate 98 having first and second ends, 100 and 102, respectively, means connecting the first end 100 of the second mounting member 98 to the side wall 20 for pivotal movement about a generally horizontal third axis 104, and means connecting the second end 102 of the second mounting plate 98 to the underside 92 of the second seat bottom cushion 90 for pivotal movement about a fourth axis 106 generally parallel to the third axis 104. As shown in FIGS. 7 and 8, the second mounting plate 98 functions in a manner similar to the first mounting plate 38. Additionally, the means supporting the second seat bottom cushion 90 includes a support bracket 108 (FIGS. 2 and 7) mounted on the underside 32 of the first seat bottom cushion 26 and extending outwardly from the left side (as viewed in FIG. 2) of the first seat bottom cushion 26. The outer end 96 of the second seat bottom cushion 90 rests on the support bracket 108 when the second seat bottom cushion 90 is in its operating position, as shown in FIG. 7.

When the second seat bottom cushion 90 is in its operating position, as shown in FIG. 2, the second seat bottom cushion 90 extends across the access opening 18. When the first seat bottom cushion 26 is in its horizontal position and the second seat bottom cushion 90 is in its operating position, the two cushions 26 and 90 form a continuous seat extending across the seating area 14. The second seat bottom cushion 90 can be moved to its storage position to afford access to the opening 18 while the first seat bottom cushion 26 is left in its horizontal position. Because the second seat bottom cushion 90 is supported by the support bracket 108 when the first seat bottom cushion 26 is in its horizontal position, the second seat bottom cushion 90 cannot be moved to its operating position when the first seat bottom cushion 26 is not in its horizontal position.

Various features of the invention are set forth in the following claims.

What is claimed:

1. A marine vehicle comprising a generally vertical wall, a seat bottom member, and means supporting said seat bottom member for movement between a first position wherein said seat bottom member extends generally horizontally from said wall, and a second position wherein said wall, said supporting means including a mounting member having first and second ends, means connecting said first end of said mounting member to said wall for pivotal movement about a first generally horizontal axis, and means connecting said second end of said mounting member to said seat bottom member for pivotal movement about a second axis generally parallel to said first axis, a retractable leg for supporting said seat bottom member in said first position, and a seat back member mounted on said wall and located between said seat bottom member and said wall when said seat bottom member is in said second position.

2. A marine vehicle as set forth in claim 1 wherein said seat bottom member has an underside, and wherein said second end of said mounting member is pivotally connected to said underside of said seat bottom member.

3. A marine vehicle comprising a generally vertical wall, a seat bottom member, and means supporting said seat bottom member for movement between a first position wherein said seat bottom member extends generally horizontally from said wall, and a second position wherein said seat bottom member extends generally vertically against said wall, said supporting means including a mounting member having first and second ends, a mounting block fixedly secured to and extending outwardly from said wall and having a thickness, means connecting said first end of said mounting member to said mounting block for pivotal movement about a first generally horizontal axis, and means connecting said second end of said mounting member to said seat bottom member for pivotal movement about a second axis generally parallel to said first axis, and a seat back member mounted on said wall and located between said seat bottom member and said wall when said seat bottom member is in said second position, said seat back member having a thickness approximately equal to said thickness of said mounting block.

4. A marine vehicle comprising a generally vertical wall, a seat bottom member having a forward end, means supporting said seat bottom member for movement between a first position wherein said seat bottom member extends generally horizontally from said wall, and a second position wherein said seat bottom member extends generally vertically against said wall, said supporting means including a mounting member having first and second ends, means connecting said first end of said mounting member to said wall for pivotal movement about a first generally horizontal axis, means connecting said second end of said mounting ember to said seat bottom member for pivotal movement about a second axis generally parallel to said first axis, an extension member, and means supporting said extension member for movement between an extended position wherein said extension member is substantially coplanar with said seat bottom member and extends outwardly from said forward end of said seat bottom member, and a retracted position wherein said extension member is located beneath said forward end of said seat bottom member when said seal bottom member is in said first position.

5. A marine vehicle as set forth in claim 4 wherein said means supporting said extension member includes a retractable leg for supporting said extension member in said extended position.

6. A marine vehicle as set forth in claim 4 wherein said seat bottom member has an underside, wherein said extension member has an underside, and wherein said means supporting said extension member includes a plate having a first end fixed to said underside of said extension member, and a second end pivotally connected to said underside of said seat bottom member.

7. A marine vehicle comprising a generally vertical wall, a seat bottom member, and means supporting said seat bottom member for movement between a first position wherein said seat bottom member extends generally horizontally from said wall, and a second position wherein said seat bottom member extends generally vertically against said wall, said supporting means including a mounting member having first and second ends, means connecting said first end of said mounting member to said wall for pivotal movement about a first generally horizontal axis, means connecting said second end of said mounting member to said seat bottom member for pivotal movement about a second axis generally parallel to said first axis, a second generally vertical wall extending generally perpendicular to said first-mentioned wall, a second seat bottom member, and means supporting said second seat bottom member for movement between an operating position wherein said second seat bottom member extends generally horizontally from said second wall and is generally coplanar with said first seat bottom member when said first seat bottom member is in said first position, and a storage position wherein said second seat bottom member extends generally vertically against said second wall.

8. A marine vehicle as set forth in claim 7 wherein said means supporting said second seat bottom member includes a second mounting member having first and second ends, means connecting said first end of said second mounting member to said second wall for pivotal movement about a generally horizontal third axis, and means connecting said second end of said second mounting member to said second seat bottom member for pivotal movement about a fourth axis generally parallel to said third axis.

9. A marine vehicle as set forth in claim 8 wherein said second seat bottom member has an underside, and wherein said second end of said second mounting member is pivotally connected to said underside of said second seat bottom member.

10. A marine vehicle as set forth in claim 7 wherein said first-mentioned seat bottom member has a side and has thereon a support bracket extending outwardly from said side, and wherein said second seat bottom member has an outer end which rests on said support bracket when said second seat bottom member is in said operating position.

11. A marine vehicle comprising a first generally vertical wall, a second generally vertical wall extending generally perpendicular to said first wall, a first seat bottom member, a second seat bottom member, means supporting said first seat bottom member for movement between a first position wherein said first seat bottom member extends generally horizontally from said first wall, and a second position wherein said first seat bottom member extends generally vertically against said first wall, and means supporting said second seat bottom member for movement between an operating position wherein said second seat bottom member extends generally horizontally from said second wall and is generally coplanar with said first seat bottom member when said first seat bottom member is in said first position, and a storage position wherein said second seat bottom member extends generally vertically against said second wall.

12. A marine vehicle as set forth in claim 11 and further comprising a retractable leg for supporting said first seat bottom member in said first position.

13. A marine vehicle as set forth in claim 12 wherein said first seat bottom member has an outer end, and wherein said marine vehicle further comprises an extension member, and means supporting said extension member for movement between an extended position wherein said extension member is substantially coplanar with said first seat bottom member and extends outwardly from said outer end of said first seat bottom member, and a retracted position wherein said extension member is located beneath said outer end of said first seat bottom member.

14. A marine vehicle as set forth in claim 13 wherein said means supporting said extension member includes a retractable leg for supporting said extension member in said extended position.

15. A marine vehicle as set forth in claim 13 wherein said first seat bottom member has an underside, wherein said extension member has an underside, and wherein said means supporting said extension member includes a plate having a first end fixed to said underside of said extension member, and a second end pivotally connected to said underside of said first seat bottom member.

16. A marine vehicle as set forth in claim 15 wherein said means supporting said second seat bottom member includes a mounting member having first and second ends, means connecting said first end of said mounting member to said second wall for pivotal movement about a generally horizontal first axis, and means connecting said second end of said mounting member to said second seat bottom member for pivotal movement about a second axis generally parallel to said first axis.

17. A marine vehicle as set forth in claim 16 wherein said second seat bottom member has an underside, and wherein said second end of said mounting member is pivotally connected to said underside of said second seat bottom member.

18. A marine vehicle as set forth in claim 11 wherein said first seat bottom member has a side and has thereon a support bracket extending outwardly from said side, and wherein said second seat bottom member has an outer end which rests on said support bracket when said second seat bottom member is in said operating position.

19. A marine vehicle comprising a generally vertical wall, a seat bottom member having a forward end, means supporting said seat bottom member for movement between a first position wherein said seat bottom member extends generally horizontally from said wall, and a second position wherein said seat bottom member extends generally vertically against said wall, an extension member, and means supporting said extension member for movement between an extended position wherein said extension member is substantially coplanar with said seat bottom member and extends outwardly from said forward end of said seat bottom member, and a retracted position wherein said extension member is located beneath said forward end of said seat bottom member when said seat bottom member is in said first position.

20. A marine vehicle as set forth in claim 19 wherein said means supporting said extension member includes a retractable leg for supporting said extension member in said extended position.

21. A marine vehicle as set forth in claim 19 wherein said seat bottom member has an underside, wherein said extension member has an underside, and wherein said means supporting said extension member includes a plate having a first end fixed to said underside of said extension member, and a second end pivotally connected to said underside of said seat bottom member.

22. A marine vehicle comprising a generally vertical wall, a seat bottom member having a forward end, means supporting said seat bottom member for movement between a first position wherein said seat bottom member extends generally horizontally from said wall, and a second position wherein said seat bottom member extends generally vertically against said wall, an extension member, and means supporting said extension member for movement between an extended position wherein said extension member is substantially coplanar with said seat bottom member and extends outwardly from said seat bottom member, and a retracted position wherein said extension member is located beneath and in generally coplanar relation to said seat bottom member when said seat bottom member is in said second position.

23. A marine vehicle as set forth in claim 22 wherein said means supporting said extension member includes a retractable leg for supporting said extension member in said extended position.

24. A marine vehicle as set forth in claim 22 wherein said seat bottom has an underside, wherein said extension member has an underside, and wherein said means supporting said extension member includes a plate having a first end fixed to said underside of said extension member, and a second end pivotally connected to said underside of said seat bottom member.

25. A marine vehicle comprising a generally vertical wall, a seat bottom member, means supporting said seat bottom member for movement between a first position wherein said seat bottom member extends generally horizontally from said wall, and a second position wherein said seat bottom member extends generally vertically against said wall, said supporting means including a mounting member having first and second ends, means connecting said first end of said mounting member to said wall for pivotal movement about a first generally horizontal axis, and means connecting said second end of said mounting member to said seat bottom member for pivotal movement about a second axis generally parallel to said first axis, an extension member, and means supporting said extension member for movement between an extended position wherein said extension member is substantially coplanar with said seat bottom member and extends outwardly from said forward end of said seat bottom member, and a retracted position wherein said extension member is located beneath and in generally coplanar relation to said seat bottom member when said seat bottom member is in said second position.

26. A marine vehicle as set forth in claim 25 wherein said means supporting said extension member includes a retractable leg for supporting said extension member in said extended position.

27. A marine vehicle as set forth in claim 25 wherein said seat bottom member has an underside, wherein said extension member has an underside, and wherein said means supporting said extension member includes a plate having a first end fixed to said underside of said extension member, and a second end pivotally connected to said underside of said seat bottom member.

* * * * *